US006018503A

United States Patent [19]

Pfister et al.

[11] Patent Number: 6,018,503

[45] Date of Patent: Jan. 25, 2000

[54] TIME ZONE INDICATOR DEVICE

[75] Inventors: Edouard F. Pfister, Sonceboz; Daniel J. Rochat, Prilly, both of Switzerland

[73] Assignee: Edouard Pfister, Sonceboz, Switzerland

[21] Appl. No.: 09/214,434

[22] PCT Filed: Jul. 3, 1997

[86] PCT No.: PCT/CH97/00262

§ 371 Date: Jan. 5, 1999

§ 102(e) Date: Jan. 5, 1999

[87] PCT Pub. No.: WO98/01795

PCT Pub. Date: Jan. 15, 1998

[30] Foreign Application Priority Data

Jul. 5, 1996 [CH] Switzerland ..... 1701/96

[51] Int. Cl.[7] ..... G04B 19/22

[52] U.S. Cl. ..... 368/23

[58] Field of Search ..... 368/15–18, 21–24

[56] References Cited

U.S. PATENT DOCUMENTS 4,056,927 11/1977 Wilson ..... 368/24

5,132,943 7/1992 Davies ..... 368/21

*Primary Examiner*—Vit Miska

*Attorney, Agent, or Firm*—Oliff & Berridge, PLC

[57] ABSTRACT

A horometric device includes a globe supported by an arbor (2) which is driven by means of a pinion (4) by a motor (5) and turns by one rotation in 24 hours. On the interior of the globe (1), a circular flat screen (23) is supported by a horizontal shaft perpendicular to the design, on a cradle (22). An eccentric (21), situated at the end of an inner arbor (19), guided in a fixed pin (20), makes this screen, bearing a lamp (26), oscillate on either side of a central position situated in the rotational axis of the globe (1), in such a way as to represent, on the one hand, day and night, and, on the other hand, the variations in the height of the sun above the equator during the seasons. The arbor (2) is driven by the pinion (17) of the same motor. A time guide-mark (10) bears radial plates (14), inner edges (15) of which are located opposite the meridians of the globe (1). This guide-mark is stationary, and allows the local time to be read at any time at any point of the globe.

14 Claims, 2 Drawing Sheets

TIME ZONE INDICATOR DEVICE

BACKGROUND OF THE INVENTION

1. Field of the Invention

The present invention proposes to answer a need which has been born and has developed in parallel with the intensification of communications over the entire surface of the terrestrial globe. Reception at home of information coming from all points on the globe, whether by private means, such as fax or telephone, or by public means, such as through television, is more and more rapid and intense. On the other hand, the ease of movements over distances covering a large proportion of the circumference of the earth is continually increasing. These realities today require, on the part of an increasing number of persons, quick knowledge of conditions (time of day or night, date, season, distances) which characterize a given place situated at a great distance with respect to the place where the person is located.

The invention aims to answer this need by creating an instrument for measuring time which gives the required information instantaneously, thanks to a synoptic display, and in a practical and manageable form. This horometric device can be achieved in a multiplicity of different forms, for example as a clock, pendulum clock, table clock or wall clock, or as a device for screen display, etc. For simplification, the general term "clock" will be used in the rest of this specification.

2. Description of Related Art

Several constructions for horological devices are already known having a substrate with a geographic representation of the surface of the globe, a time guide-mark and means to display a marking representing the line of movement of the twilight or crepuscule, these components being driven by a motor assembly, the relative movements simulating the movements of the earth with respect to the sun.

German patent application DOS 2 018 727, published in 1971, suggests using as a substrate a spherical shell supported by a coaxial arbor at the line of the poles and, as a means to display the crepuscular line, a second hemispherical, transparent or tinted shell, partially surrounding the substrate, pivoting about an axis which is perpendicular to the line of the poles and passing through the center of the globe. The time guide-mark is a ring, fixed or capable of slight oscillating motion, which surrounds the substrate at the level of the equator or in the vicinity of the south pole.

However, the teachings of this publication only partially answer the needs mentioned above: on the one hand, the clock is conceived mainly as a horological instrument measuring sidereal time and not mean solar time; on the other hand, the design of the time guide-mark and its cooperation with the geographical representation borne by the substrate do not permit an easy reading of the local time at any moment in all the time zones. Lastly, the driving mechanisms provided are relatively complex.

Another prior art document, the French patent FR 1.411.022, proposed a similar construction in 1965 in which the substrate has the shape of a cylindrical body bearing a geographical representation of the terrestrial globe of the Mercator type. The means of display of the crepuscular line is a screen, equipped with a lamp, mounted pivoting on the interior of the substrate.

Also in this case the time guide-mark is a simple ring situated at the base of the substrate, which impedes easy reading of the local time at any point of the geographic representation, and the motor means necessary in the case where an entirely automatic and regulated drive must be provided appear complicated.

The patent application EP 0 441 678, published in 1991, also relates to a terrestrial globe mounted so as to simulate the movements of the earth with respect to the sun. However, this design, which includes relatively complex mechanisms, is mainly conceived so as to indicate sidereal time, and its time guide-mark does not allow an easy reading of local time.

The result of this analysis is that in order to answer the current needs, defined at the beginning, it is necessary to create a horometric device which has a maximum of quality with respect to the following three points of view:

Easy reading of local time,

Clear simulation of the real movements in the solar system,

Simplicity of construction.

SUMMARY OF THE INVENTION

The present invention aims to attain this object.

The inventive idea consists in producing the movements of the terrestrial globe with respect to the base of the device in such a way that seen from a privileged side of the clock, they present themselves so as to appear to a fictive observer looking at the earth from a point situated on the straight line which joins the center of the earth to the center of the sun, or to a fictive observer who is moving in a plane perpendicular to the ecliptic and containing this line.

The result is that the definition of the invention covers four types of designs which represent in an exhaustive way the possibilities of simulation defined above.

However, before naming them, it is important to make it clear that the design of the means provided on the geographic representation of the globe and on the time guide-mark, allowing an immediate reading of the time, also constitutes an important element of the invention.

The geographic representation will bear the limits of the time zones. These are often different, at least on the continents, from the markings of the meridians delimiting the time zones. Moreover, the meridian which determines the local time in each time zone, and whose distance from the Greenwich meridian is a multiple integer of 15 degrees, will bear one or more indicating symbols, specially marked. For example, these symbols could be marked by a colored or luminescent coating or allow the substrate to appear in the case where this is transparent or translucent so that an interior lighting means makes them visible.

As concerns the time guide-mark and its indicating elements cooperating with the indicating symbols, different possible embodiments for this rigid element will be seen further below. Being intended to cover over the geographic representation at least partially, these covering parts will be preferably transparent, only the time elements being visible, strictly speaking. At its base, preferably on a collar surrounding the arbor, in the cases where the substrate is a three-dimensional body, or on a longitudinal band of the guide mark in the case of a flat or curved execution, a graduation of 0 to 24 o'clock will be provided, with, if needed, subdivisions if the dimensions allow them. When their number is a submultiple of 24, the time elements have at least the element of 12 o'clock which determines with the central point of the globe the plane which is called the solar plane.

The arrangement of the motor assembly includes the four embodiment types which seem to ensure the sought combination of advantages: legibility of the synoptic display, clarity of the simulation of the real movements, simplicity of construction.

Two of these embodiments are shown in FIGS. 1 and 2. In the embodiment according to FIG. 1, since the time guide-mark and the axis of the substrate are fixed, and the crepuscular plane oscillates about a line passing through the center of the globe and perpendicular to the line earth-sun, the fictive observer who "sees" the fixed axis of rotation and the crepuscular plane oscillating is considered as moving in the solar plane by moving away from or moving closer to the plane of the ecliptic, while more or less inclining, alternatively between the two directions.

A variant of this embodiment in principle consists in providing that the crepuscular plane is fixed, but that the assembly of the socle, the time guide-mark and the globe with its arbor carries out an oscillating movement about an axis parallel but being able to be offset with respect to the axis of oscillation of the crepuscular plane in the preceding embodiment. The fictive observer then remains placed on the line earth-sun, but is more or less inclined so as to see the axis continually straight whereas in reality it describes a circular translatory movement in an oblique position, inclined at 23.5 degrees with respect to the perpendicular to the plane of the ecliptic.

The third solution is that which is represented by FIG. 2: the fictive observer is constantly located on the line earth-sun and consequently sees the crepuscular plane perpendicular to the direction of his gaze. The axis of the globe describes, in oblique position, a rotational movement about a line passing through its center and perpendicular to the plane of the ecliptic and the time guide-mark whose solar plane is constantly oriented toward the observer describes a slow, balanced movement simulating the real movements of the earth even better than in the preceding embodiments.

Finally, the fourth solution consists in transposing the geographic representation of the globe on a flat or curved surface, this representation moving from east to west under a grid which has a network of lines forming time elements oriented parallel to the meridians. On such a representation the crepuscular line is then a line having the look of a sinusoid which moves northward or southward as a function of the course of the seasons. Also in this case, the mobile indicating symbols of the geographic representation and the time elements of the fixed time to guide-mark will cooperate to allow an easy reading of the local time.

According to the invention, the geographic representation of the terrestrial globe in fact comprises a single indicator element, which can have the shape of a sphere or any other axially symmetrical body, but which can also be a flat or curved surface.

This indicator element cooperates with a time guide-mark, and the display device functions so as to create a relative, periodic displacement between the time guide-mark and the indicator element, which implies that the one or the other of the two elements can be fixed, whereas the other is mobile, or else that the two elements are mobile with respect to a same base which is fixed. As can be seen, the embodiments which seem the most advantageous comprise an indicator element having a periodic displacement with a period of 24 hours with respect to the base, and a time guide-mark which is fixed, or which, at the very least, maintains a constant, fixed orientation with respect to the base.

However, embodiments in which the geographic surface is fixed and the time guide-mark moves are also possible. It is to be noted, however, that the auxiliary indicator means, which has as a function the marking of the crepuscular line on the indicator element, must entail a more complicated absolute movement if the indicator element is fixed than if it makes a periodic displacement with a period of 24 hours, and in particular a rotational movement about an axis.

To mark continuously the tracing of the crepuscular line on the surface of the globe, the auxiliary indicator means must be designed so as to divide the surface of the terrestrial globe into two parts according to a large circle whose plane is constantly oriented toward the sun, and thus is located perpendicular to the plane of the ecliptic. Since, in astronomical reality the earth makes a movement in space, with respect to the sun, in such a way that its axis of rotation describes a circular translation movement about the sun, while remaining inclined by 23.5° with respect to a perpendicular to the plane of the ecliptic, the transposition of this movement and of the actual rotation movement of the earth on a model able to be constructed in the form of a clock presents a certain number of difficulties. These difficulties are resolved in the clocks described in the following by providing for a relative periodic displacement having a period of precisely 24 hours between the time guide-mark and the indicator element, and between the auxiliary indicator means and the time guide-mark a relative periodic displacement which has a normal period of 365 days and can be corrected at leap year in such a way as to be lengthened to 366 days. Thus the clock described functions on the basis of a time counting referring to the second. It constantly indicates the mean true solar day, and the course of the normal calendar can be continuously displayed, it being possible to make the increase of the annual period to 366 days at leap year automatically on the basis of a program incorporated into the time base or at will by means of a corrector accessible to the user.

One possible embodiment for the auxiliary indicator means consists in a circular screen bearing a lamp on one of its faces. This screen is mounted inside the indicator element of spherical shape and cooperates with the drive means which impart to it a movement corresponding to the required function. If the globe is fixed, which means, consequently, that the time guide-mark turns with a period of 24 hours about the polar axis, then the inside screen must be driven, on the one hand, according to a rotational movement identical to that of the time guide-mark in such a way as to be constantly oriented according to the plane in which the meridians are located whose local time is 6 o'clock (6 a.m.) and 18 o'clock (6 p.m.), and, on the other hand, according to a movement of oscillation, of an amplitude ±23.5°, about an axis which is perpendicular to the preceding. In the opposite case, where it is the globe which turns about the polar axis and the time guide-mark, coaxial to the globe, remains oriented in a fixed direction, then the time symbol 12:00 remains constantly oriented toward the sun, and to simulate this situation, the interior screen is only propelled according to a single movement, which is the oscillation movement described above. From the point of view of construction, this embodiment is relatively simple, and it is the one which will serve as the first example described in detail in the following.

Before passing on to the description in detail, it should be mentioned that the time guide-mark in the majority of embodiments consists of a rigid element which has certain general features. For instance, this rigid element will be configured according to the shape of a hollow body, certain parts of which can be made of a transparent material and into which the indicator element representing the surface of the terrestrial globe will be partially or entirely engaged. The time guide-mark will be an axially symmetrical body, coaxial with the indicator element. It will bear on one or more visible zones radial lines representing the hours marked from 1 o'clock to 24 o'clock. This time guide-mark can be designed, for example, in the form of a dome in the portion of a sphere partially surrounding the southern hemisphere of the geographic representation of the terrestrial globe.

This dome will be made of a transparent material and its shape will be adapted to that of the substrate so as to cover it tightly. At its base a circular collar of flat, frustoconical or even curved shape will bear the time graduation 0 hour–24 hours, whereas on the dome, strictly speaking, the engraved lines will form the time elements.

However, an embodiment which seems at the same time aesthetic and particularly effective consists in giving the time guide-mark the shape of a flat, truncated cone placed under the terrestrial globe and provided with a certain number of transparent plates, disposed on edge as a star around the axis. These plates will each have a curved edge extending opposite the surface of the globe along the marking of the meridians. Four or eight plates can also be provided representing the hours 6 in 6 or 3 in 3 hours. These plates can be extended, for example, to the height of the earth's equator or even higher. They will be sufficiently transparent not to impede the view of the geographic surface of the globe.

In the case where the periodic, relative displacements defined further above are real displacement of solid elements in movement with respect to one another, the clock will comprise one or more motors. In fact, all the required movements can be produced starting from a single motor into which a reduction gear will be incorporated with two output shafts. This motor can be of any type, for example a stepping motor or a synchronous drive motor. It will be controlled preferably by a time base, for example of the quartz type, although an electric motor controlled by the power supply network frequency, depending upon the case, could also be sufficiently reliable. In another category of ideas, if entirely mechanical embodiments are desired, a spring motor, of the classic type, able to be wound by hand or, as the case applies, automatically as a function of variations in temperature or variations in pressure can likewise be provided.

Resulting from the concept of the present invention is that the counting of days by addition of the hours elapsed as well as the display of the date and of the month will be derived directly from the time base, and the display of these parameters will be dissociated from the auxiliary indicator whose function is strictly limited to marking the crepuscular line and to indication of the direction in which the sun can be found, in particular the height of the sun above the line of the equator and its variations in the course of the seasons. Thus, for display of the calendar data, the base or the socle of the clock will bear display means, preferably of the digital type, allowing convenient reading of the date, the month, if applicable the year, the day of the week or any other interesting indication. The cabinet of the clock can also bear a classic dial with hour and minute hands on 12 hours, settable to a preferred time zone.

The study of the functions that have been interesting to display has shown that an indicator means for the change of date has been able to be of service. One knows in fact that with the exception of the instant when the date change meridian is located at the local time 24 o'clock (midnight), the different points of the surface of the globe do not have all the same date. Those which are situated between the date change meridian and that which is located at the local time 24 o'clock (or 0 o'clock) and which are situated west of the date change meridian have a date which corresponds to a current new date, whereas the other points of the globe, situated to the east of the date change meridian still have the old date. A device displaying this particularity could therefore be provided. It could be of electronic type. It could then include, for example, 24 cells of the luminescent diode or LCD cell type distributed on the circumference of the globe. These cells are preferably located on that of the two elements indicator/time guide-mark which is fixed whereas a sliding contact mounted on the rotary element and turning therewith will successively excite these cells as they rotate in such a way that the excited cells designate the parts of the globe having the new date. The passage of the date change meridian at the local time 24 hours will result in the immediate de-energizing of all the cells. A device having exactly the same effect, but constructed in an entirely mechanical fashion, can easily be conceived, according to different models. We shall return to this point further below.

In these general remarks, two additional improvements should be mentioned which can also be provided. For instance, on the surface which represents the terrestrial surface, a certain number of particular points can be determined which are nodes of routes, for example the sites of certain large airports. These route nodes will be provided with identification means of an electronic type and will be registered in a program memory with the necessary data. The program in question will include an instruction to calculate and to search allowing the series of route nodes to be determined corresponding to certain initial conditions which can be selected at will. Thus, for example, if a first route node has been designated as departure point, then a second route node has been designated as destination point, the program could determine, for example, the fastest route, within certain general conditions, between the departure point and the destination point by passing through a minimum number of route nodes, and display the trajectory thus determined by exciting the different route nodes concerned. It is known that this function of determining routes is particularly simple to achieve if the indicator element and the time guide-mark are flat surfaces, and more precisely surfaces of a screen of an electronic display console.

Finally, in the embodiments in which the substrate of the geographic representation is an axially symmetrical body and the time element for 12 o'clock of the time guide-mark remains constantly directed to the side from which the clock will be looked at, it can be interesting to provide a means allowing a portion of the globe to be easily seen, if desired, in which the local time differs greatly from noon. Therefore, in all the embodiments a supplementary mounting has been provided in which the base is additionally supported by a console, or a foot, and a manual drive or a drive by auxiliary motor enables it be turned quickly in one direction or the other. This movement can be limited to 180 degrees. A control means mounted on the console allows this rotation to be actuated at will. Such a console also allows, for example, accommodation of control means for the function, which will be described, to display routes, or of means to excite on the geographic representation the contour of the time zone which is thus brought into a favorable observation position.

At the same time, the indicating symbols corresponding to the meridian of the local time of this time zone can be excited. This last function, finally, can also serve to display the adjusted local time in the time zones (winter time— summer time). Thus, for example, in the zone for Central Europe, the winter time is the mean solar time of the meridian +15 degrees (passing a little to the east of Berlin) and the summer time is the mean solar time of the meridian +30 degrees (passing near St. Petersburg).

BRIEF DESCRIPTION OF THE DRAWINGS

Various exemplary embodiments of the invention will be described in detail with reference to the following figures, wherein.

Figure 1:
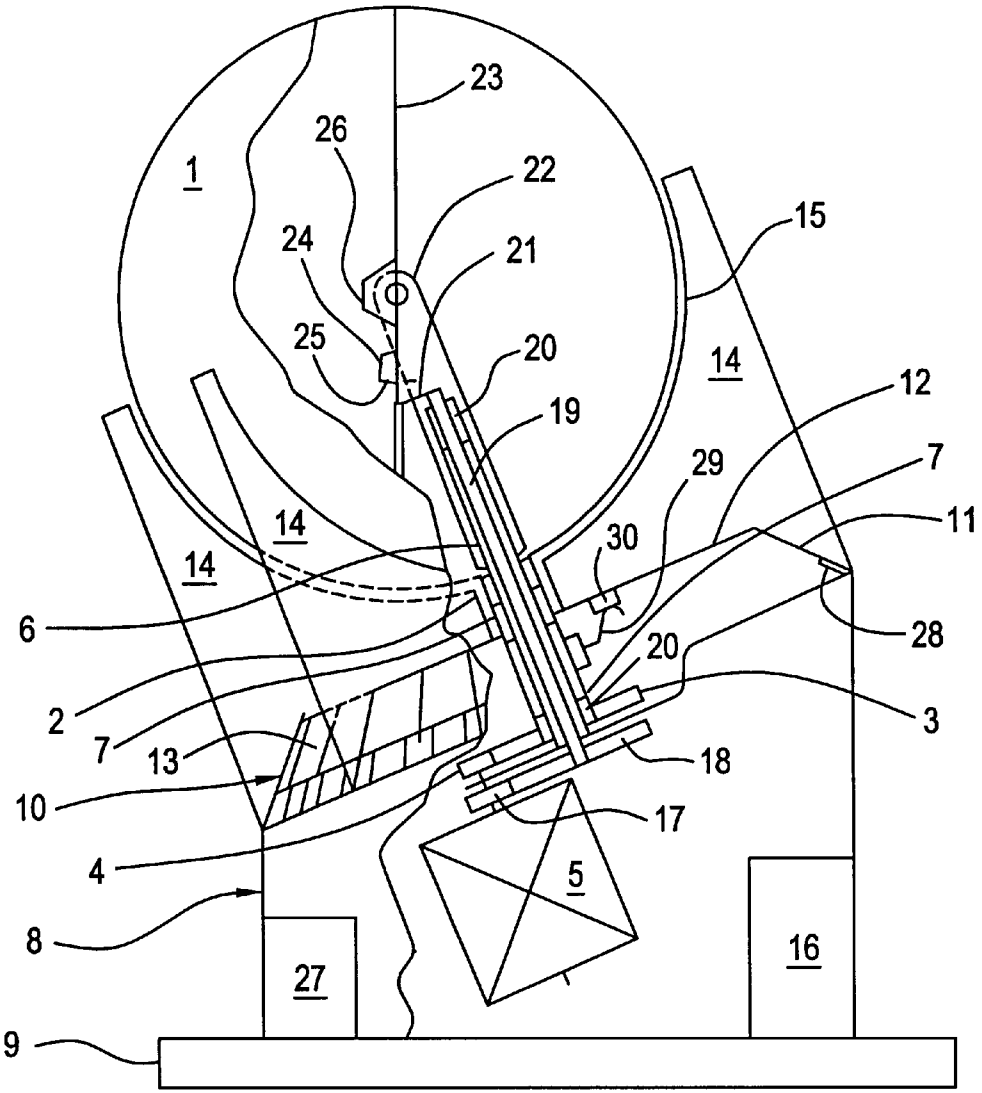
FIG. 1 is a partial cross-sectional view of a horometric device according to a first embodiment of the invention.

The clock of FIG. 1 comprises an indicator element 1 in the form of a spherical shell of semi-transparent material, bearing a decoration which represents the surface of the terrestrial globe with its meridians. This shell (1) is integral with a tubular arbor (2) which itself is fixed to a site representing the south pole and which is oriented according to the axis of the globe. At its lower end, this arbor (2) bears a toothed wheel (3) which engages in a pinion (4) mounted on an output shaft of a motor (5). The arbor (2) and the globe (1) are guided and supported by a fixed pin (6) which passes through the arbor (2) along its entire length and is prolonged inside the globe (1) for a certain distance. Provided are exterior bearings (7) which guide the arbor (2). This pin which is itself hollow, forms part of the armature of a socle (8) integral with the base (9) of the clock. The socle (8) has a cylindrical shape, with a vertical axis, but its upper face is inclined, the pin (6) perpendicular to said upper face being itself inclined by 23.5° with respect to the vertical. The axis of the globe (1) thus has the same inclination as the earth's axis with respect to a perpendicular line to the plane of the ecliptic.

It is to be said, however, that in the embodiment represented in FIG. 1, this inclination of the axis of the globe of 23.5° with respect to the vertical is purely conventional. The same embodiment could also be provided with a vertical axis of the globe. Seen later on will be the minor changes which that would entail.

The globe (1) is thus driven in rotation starting from a motor (5) by the wheel (3) at a rate of one turn in 24 hours. It cooperates with a time guide-mark (10) which is fixed and is integral with the socle (8). This time guide-mark comprises a frustoconical base (11) with a flat upper face (12) and a lower face serving to fix the indicator to the socle (8). The base (11) is therefore coaxial to the arbor (2), the upper face (12) being pierced by an opening allowing passing of this arbor. On the lateral frustoconical surface of the body (11) symbols (13) are marked in the form of radial lines, cutting the periphery of the time guide-mark into 24 divisions which correspond to the 24 hours of the mean solar day. Moreover, to facilitate reading of the time, the face (12) of the time guide-mark (10) bears a certain number of radial plates (14) which are placed on edge on the regularly spaced time divisions. Thus, in the case where 8 plates (14) are used, they will be oriented at 45° with respect to one another and will fix the position of the hours 3, 6, 9, 12, 15, 18, 21, 24. As can be seen in FIG. 1, the inner edges (15) of the plates (14) are curved according to arcs whose radius corresponds to that of the globe (1) in such a way as to facilitate estimation of the local time at any point of any meridian of the globe (1). In FIG. 1, the plates (14) extend to the height of the equator, but it is clear that, depending upon the case, they can have a different height.

The motor (5) controlled by a time base (16) and whose frame is fixed to the socle (8) thus drives the different zones of the terrestrial globe, moving past in front of the time symbols (13) and the plates (14) by going eastward. That is to say a turning in the reverse direction to that of the hands of the clock, when looked at from above, from the north pole to south pole axis. To display the zones of day and the zones of night, the clock includes an auxiliary indicator means which, in some respects, plays the role of the sun. As the time guide-mark is fixed, and the direction of 12 hours corresponds approximately to the direction of the sun, one selects, for example, the plate (14) depicted on the left in FIG. 1, as the plate representing the time symbol 12 hours. Under these conditions, the auxiliary indicator means will comprise the following elements: first of all, the motor (5) is equipped with a second output shaft which, in FIG. 1, is coaxial to that bearing the pinion (4), and which itself bears a pinion (17). This pinion (17) engages with a wheel (18) which is driven so as to make a turn around itself in 365 days under normal conditions. This wheel (18) is integral with an inner arbor (19) which is led on the inside of the pin (6) and guided by bearings (20). This arbor (19) ends a little below the center of the globe (1) and at its end bears an eccentric (21). The pin (6) supports, on the other hand, a semicircular cradle (22) whose plane is oriented perpendicular to the plane of the drawing of FIG. 1, and whose two branches extend along the meridians of 6:00 and 18:00 on the inside of the globe. The ends of the two branches of the cradle (22) are located at the height of the equator, that is to say that they determine an axis perpendicular to the plane of the drawing in FIG. 1 and passing through the center of the globe. The ends of the two branches of the cradle (22) serve as bearings with tips which project from a flat circular plate (23), made out of an opaque material, which is thus suspended on the interior of the globe (1) according to the horizontal axis described above. This plate is indented in the region located at the height of the eccentric (21) and comprises a folded up, small tongue (24) with a slit (25) in which the beak of the eccentric (21) is engaged. Therefore, the plate (23) carries out a double oscillating movement during each annual period, and the disposition of the small tongue (24) and of the eccentric (21) are such that the amplitude of the oscillation movement is exactly ±23.5° on both sides of the plane perpendicular to the drawing and containing the axis of the globe. In the position represented in FIG. 1, this flat circular plate, which plays the role of a screen, is disposed vertically, and one understands that this particular position corresponds to the date of the summer solstice. On the date of the winter solstice, the position of the screen (23) is symmetrical with respect to the axis of the poles that of which corresponds to the summer solstice, whereas at the time of the equinoxes the screen (23) is located in the plane perpendicular to the drawing and containing the axis of the poles.

Since the material of the spherical globe (1) is semi-transparent, it can suffice if the face of the screen (23) turning towards the left in FIG. 1 is colored brilliant white, while the other face is black to create the impression on the spherical globe (1) of the line of twilight dividing the illuminated zones of the globe from those which are in darkness. However, one could also supplement the screen arrangement by placing on the face turned toward the left a bulb such as the bulb (26) which is constantly lit or can be lit at will.

In addition to the auxiliary indicator means (23) (26) described above, the clock of FIG. 1 comprises devices for display of the digital type sketched in (27) on the socle (8), indicating, for example, the date, the month and the year.

The corresponding counting devices can be equipped with an automatic corrector displaying automatically every four years the $29^{th}$ of February of the leap years.

However, as concerns the display of the date, the change of date must of course be synchronized with the local time 24:00/0:00 of one of the time zones, for example the time zone of central Europe, but this indication bears the risk of being insufficient, in certain cases, if the user considers, for example, the movement of an airplane in the direction of Australia or one of the countries of the Far East. To resolve this problem, the clock shown in FIG. 1 further comprises a date change device. Thus, mounted on the interior of the body (11) of the time guide-mark (10) is a series of 24 luminescent diodes, designated by (28), and placed in such a way that each is on top of one of the time symbols (13). On the other hand, mounted on the arbor (2) which supports the globe (1) is a contact element (29) which cooperates with a series of corresponding contacts (30), likewise placed on the body (11), for example on the reverse side of the upper flat surface of this body. These simple means enable it to be indicated at every second which zones of the globe have the same date, for example central Europe, and which still have a date corresponding to one day prior or have a date corresponding to one day after. One knows in fact that when the date change meridian, the line of which is approximately opposite the Greenwich meridian, passes to the local time 24:00/0:00, the entire surface of the globe has the same date, but that immediately after this moment, the local time west of the date change meridian reaches a date, whose date of the month is one unit higher than the former date of the month. Synchronized with this movement, the contact (29–30) will cause the excitation of that one of the diodes (28) which corresponds to the position of the date change meridian at that moment. Therefore, progressing with the rotation of the globe eastward, the diodes borne by the time guide-mark (10), staggered eastward with respect to the time symbol 24 o'clock and to the line of which the date change meridian passes, will be excited and will remain illuminated, indicating that in the corresponding regions of the globe, the date of the month is the new date. This progressive movement goes on until the indicator element (1) has carried out one complete rotation around itself, the date change meridian being located at the position of 24:00/0:00, the moment at which all the diodes will extinguish themselves, the first diode (28) only being reactivated when the zone of the date change meridian reaches the new date of the month.

This date change indicator device can also be supplemented by a double display of the date of the month in the field (27) in such a way that the users always have before their eyes indications of the two dates in question.

The date change indicator device can also be entirely mechanical. For this, one has a choice from among several different constructive principles. Thus, for example, the different cells (28) can be replaced by a series of circular apertures made in an annular plate which surrounds the arbor bearing the globe (1). A second plate disposed under the first annular plate has an upper surface of a certain color which appears in all the apertures at the moment corresponding to the extinction of all the diodes in the case of an electronic device. When, in the movement of rotation of the globe, the date change meridian passes on the time symbol 24, a finger piece being dragged along, integral with the arbor of the globe, hooks a piece in the shape of a split ring, which is disposed under the second fixed plate, but extends beyond it to the right of the symbol for 24 hours through an aperture. This split ring will be retained by a spring. During the period of 24 hours which begins with the hooking of the split ring, the latter, whose surface can be colored a light color, will be pulled along progressively under the apertures so that, progressively with its advance, the color visible through these apertures will change, for example, from dark to light. At the end of the turn a catch will release the split ring which, pulled back by its spring, will resume instantaneously its initial position, and the cycle can begin again.

One can also dispose on the circumference of the time guide-mark a series of levers turning about axes distributed along the date change device. These levers cooperate with flexible arms of an annular spring plate in such a way as to have two stable positions in one of which a light part of the lever appears in the corresponding aperture, whereas in the other position, it is the other part, dark, of the lever which is visible through the aperture. The desired functioning is ensured by the simple fact that the drive shaft of the globe pulls along a finger piece able to actuate successively all the levers, and to cause, at the moment where it stops its complete rotation, a displacement of a lever articulated and hooked to a retaining ring. The latter, released by a spring, brings all the levers back into their initial positions at the same time.

Therefore, the clock described can be designed in an entirely mechanical fashion, without any existing exterior source of energy.

In a variant to this first embodiment, already mentioned in the foregoing, the drive means can be simplified while improving the quality of simulation of the real movements. Returning to FIG. 1, this variant consists in replacing the drive mechanism (18), (19), (21), (24) of the screen (23) with a simple suspension equipped with a counterweight so that the screen places itself naturally in a position of equilibrium in which it is vertical or possibly has a predetermined inclination. On the other hand, the socle (8) will be separated from the base (9) and mounted pivoting with respect thereto about an axis parallel to the suspension axis of the screen (23). The motor (5) can remain integral with the socle. Instead of the exit pinion (17) it will comprise an output shaft parallel to the two aforementioned axes. The base will comprise a fixed crown, or even a toothed sector in which the pinion replacing the pinion (17) engages. This output shaft of the motor will be controlled in such a way as to make the socle and the assembly of mechanisms which it bears oscillate with an amplitude of 47 degrees and a period of 365 times 24 hours, able to be modified to 366 times 24 hours once every 4 years. The control of the stepping motors allows the rates of this genre to be attained without difficulty.

It will be noted with this variant that the quality of the simulation of the movements is better than with the construction in FIG. 1. In fact, if the inclination of the axis of the poles is 23.5 degrees in the example chosen, that value is arbitrary and the variations in apparent inclination of the axis of the poles was not simulated, whereas it is with the variant comprising two parallel axes of oscillation which will be described.

It is important to emphasize again that use of the circular screen, whose edge follows the interior surface of the substrate and of the lamp placed on one side of this screen is not the only possible solution for display of the crepuscular line on the geographic representation. By using one or more lamps of another type than the incandescent filament lamps, directed light rays or sheets of light which do not require the presence of physical screens can be produced. One knows that the use of such screens requires in fact a spherical shape to be chosen as the shape of the substrate, whereas the shapes of cylinders or ellipsoids could be advantageous, depending upon the case.

Figure 2:
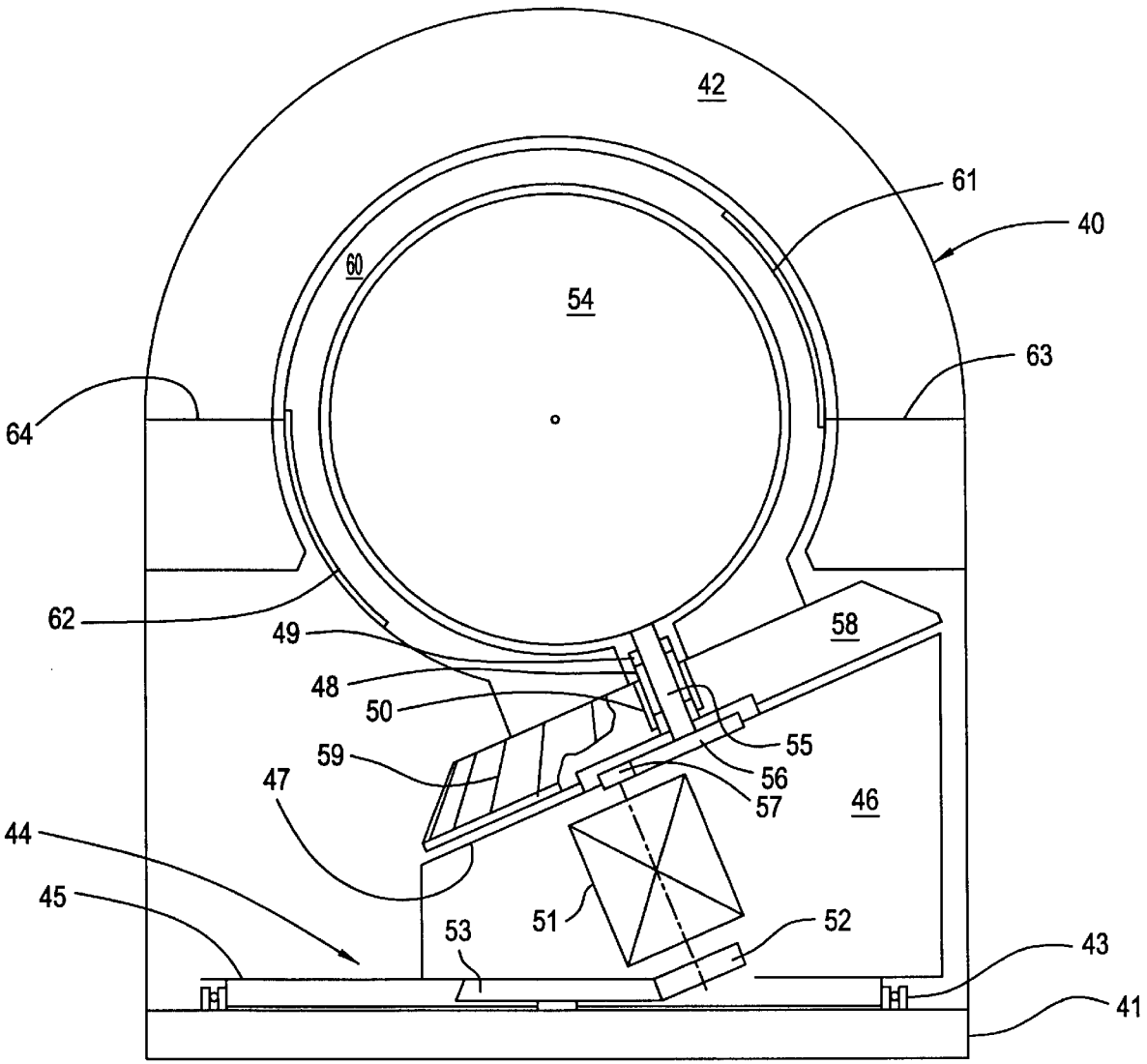
FIG. 2 is a partial cross-sectional view of a horometric device according to a second embodiment of the invention.

The embodiment represented in FIG. 2, which we shall now consider, differs from the first as regards the principle of transposition into a concrete model starting from the astronomical reality. Nevertheless, it has the same advantages of synoptic reading of the time in the different time zones. Here the elements of the clock are contained inside a cabinet (40) which has been given a cylindrical shape with a rounded, semicircular upper part. At the base (41), this cabinet comprises a cylindro-hemispherical covering entirely of a transparent material. It is evident, however, that any other shape of cabinet can be provided in this second embodiment of the clock described. The functional elements are entirely visible, and the positions which they occupy in FIG. 2 correspond to those which they occupy at the time of the equinox. The direction from which the solar light comes is therefore located oriented along a perpendicular line to the plane of the drawing. The sun can just as well be supposed in front, or behind, with respect to this plane.

Fixed on the interior of the cabinet (40) is a screen (42) made up of a transparent, flat plate in the arc of a circle, having a different coloring on its two faces, that is to say a light coloring on the side where the solar light source is located, and dark on the other side. It is possible to also provide an outside lamp illuminating the terrestrial globe in order to mark the crepuscular line on its surface. However, the screen (42), with the different colorings on its two faces, can suffice to represent, at least approximately, this marking. The mobile parts of the clock displace themselves in a complex movement, which will be described later, on the interior of the contour of the screen (42).

The upper face of the base (41) bear a guide element (43), such as a slide, rail, roller track, etc., whose contour is circular, horizontal and centered on the vertical axis of the clock. This guide means allows the socle (44), of which one recognizes the general shape, analogous to that of the socle (8) of the first embodiment, to carry out rotation movements about said axis. This mobile socle comprises, on a circular base plate (45), a cylindrical box (46), off-center, whose upper face (47) is inclined. Whereas the circular edge of the plate (45) cooperates with the guide means (43), the upper face (47) is integral with a hollow pin (48), equipped inside and outside with bearings (49 & 50). As in the first embodiment, the axis of the pin (48) is inclined by 23.5° with respect to the vertical, and it will be noted that the relative dimensions of the elements are such that the axis of the pin (48) continuously cuts the axis of vertical symmetry of the clock at a point which is fixed, and which corresponds to the center of the hemispherical dome of the cabinet.

A motor (51) whose frame is fixed in the box (46) of the socle (44) possesses an output shaft equipped with a pinion (52) which engages in a fixed, circular rack (53), integral with the base (41). This circular rack is also centered on the central vertical axis of the clock, so that the rotation of the pinion (52) in the rack (53), drives a rotation movement of the socle (44) on the guide means (43), that is to say a movement of rotation about the central vertical axis of the clock. One understands that the speed of this rotation movement will normally be 1 complete turn in 365 times 24 hours, so that the axis of the hollow pin (48) functions during this period as the generatrix of a double conical surface, whose vertex is located at the central point of the clock where the vertical axis and the oblique axis of the hollow pin intersect, and whose aperture angle is 47°.

In FIG. 2, the reference numeral (54) designates a spherical globe of a rigid material, which can be opaque or transparent, and which has on its outer surface a representation of the surface of a globe. The center of this globe coincides naturally with the previously indicated central point of the clock. This shell is borne by an arbor (55) engaged inside the hollow pin (48) and guided by 20 the two bearings (49) disposed inside this pin. At its lower end, the arbor (55) bears a toothed wheel (56) which engages with a pinion (57), constituting a second output shaft of the motor (51). The speed of rotation of the drive elements (57 & 56) will be such that the sphere (54) makes one complete rotation around itself in 24 hours. As in the first embodiment, the globe (54) functions as a 25 synoptic indicator element, in cooperation with a time guide-mark which is borne by the socle (44) and which is coaxial to the hollow pin (48). This time guide-mark comprises a body of frustoconical shape (58), whose lateral surface bears time symbols from 1 to 24 designated by (59). Moreover, a certain number of transparent plates (60) are fixed on the flat upper face of the body (58) in orientations corresponding to the direction 6:00/18:00 (6 a.m./6 p.m.), 12:00/24:00 (12 noon/midnight), 3:00/15:00 (3 a.m./3 p.m.), etc. In the drawing one sees the plate (60) corresponding to the divisions 6:00/18:00 (6 a.m./6 p.m.) of the day and notes that this plate forms a complete annulus. In the position represented in FIG. 2, it is co-planar with the screen (42), the outer edge of this plate following the inner edge of the screen, whereas the inner edge of the plate extends a short distance from a large circle of the globe (54) passing through the north and south poles. However, this position is momentary. It is only reproduced on the dates of the equinoxes. The body (58) is guided on the exterior bearings (50) of the fixed pin (48) so that it remains coaxial to the pin under all circumstances.

To ensure the functions which the time guide-mark, described above, fulfils, a last configuration has been provided which consists in that two portions of the arc of the outer edge of the element (60), designated by (61 & 62), are provided in their edge faces with a groove to which a rigid rod (63), respectively (64) corresponds, sunk into the plate of the screen (42), extending horizontally to the height of the central point of the clock. The ends of these rigid rods penetrate into the grooves (61 & 62). Thus, while allowing the time guide-mark to turn about the pin (48), as a function of the annual rotation movement of the socle (44) about the central vertical axis of the clock, the rods (63 & 64) keep the time guide-mark in a fixed orientation so that, for example, a perpendicular to the plane of the plate (60) will remain included, throughout the rotation of the socle (44), in a vertical plane perpendicular to the plane of the screen. Then, the plate (60), to take this example, will execute an oscillation movement about the horizontal axis defined by the rods (63 & 64), while combining this oscillation movement with a rotation about the central axis perpendicular to the plane of the drawing.

In fact, the operation, which will be described, can also be obtained by imparting to the time guide-mark (58, 59, 60) a movement of rotation about its axis, in relation to the socle (46), the speed of this movement being equal to, and in the opposite direction from, the movement of the socle about the crown (53).

One will note further, as concerns the direction of rotation, given in the arrangement represented in FIG. 2, if the sun is supposed to be in the front of the drawing, then the relative position of the elements corresponds to the spring equinox. The direction of rotation of the globe about its axis being the direction of west to east, that is to say the direction reverse to that of the hands of the watch seen from the north pole to the south pole, the rotation of the socle (44) will likewise take place in the direction opposite to the hands of the watch seen from above looking down, so that starting from the position shown in the drawing, a rotation of one quarter of a turn of the socle (44) brings the upper edge of the box (46) behind the plane of the drawing, and the north pole is located in front of the screen (42), which corresponds well to the position of the summer solstice.

The supplementary mounting of the base on a console, mentioned above, will require here a vertical axis of rotation. This could be parallel and non-coinciding with the axis of the crown (53), and thus could reproduce the orbital movement of the terrestrial globe.

The calendar and date change devices described with respect to the first embodiment are not represented in FIG. 2. It is well understood that the clock can also include all these devices, and this applies in the one or the other of the diverse embodiments which have been mentioned.

The configuration in FIG. 2 has a particular advantage: the relative positions of the two points which represent the center of the terrestrial globe, on the one hand, and the sun, on the other hand, are fixed. In other words, the line of the twilight is a fixed circle on the spherical globe which represents the terrestrial globe, so that the two halves of this globe, which represent respectively the zone of the day and the zone of the night, are always located at the same places with respect to the base and the cabinet of the clock. These two zones are separated by the screen (42). One could also mark the line of separation between the zone of day and the zone of night in another way than by the screen, which could be omitted in this case. One could, for example, color in a different way the parts in front of and behind the hemispherical and partially cylindrical dome which forms the walls of the cabinet (40). It will be recalled that, in the embodiment described, the line of separation is located in the plane of the drawing, according to FIG. 2. One could also combine this difference between the zones with an embodiment of the spherical shell in a material which reflects or diffuses the light differently depending upon the wavelength. In this way, the zone of the globe which is illuminated and which represents the day zone could be made to appear luminescent. This arrangement can be combined with the representation of the geography of the globe, in particular with the contour of the continents and islands, the lands coming into view being treated in a fashion so as to be luminescent, yellow, ochre or green by day, the oceans and seas being luminescent blue by night.

To resolve the practical and aesthetic problems of realization, techniques of illumination can be applied, in particular the use of monochromatic light emitters, diodes, liquid crystals, optical conductors in the form of fibers or non-crystalline substances, etc. In several of the embodiments described, the substrate contains no outside-connected mechanism so that it is possible to have the electrical or optical conductors pass through the arbor.

Finally we shall return briefly to the embodiments already mentioned and including a flat arrangement of the indicator element and of the time guide-mark. In such embodiments, the terrestrial globe will be represented in the form of a planisphere, for example a Mercator projection, such that the meridians are then straight lines parallel to one another and perpendicular to the line of the equator.

Conforming to the rules defined above, to attain the stated object in an execution of this type, the time guide-mark will be a fixed element superimposed on the geographic representation and having the time guide-marking elements in the form of lines parallel to the meridians. For example, the time guide-mark will be a transparent plate in which the time elements will be lines engraved or printed in another way.

Different configurations can be provided for the geographic representation. One especially simple arrangement consists in mounting under the time guide-mark a continuous band supported between two drums and bearing two times the geographic representation of the terrestrial globe in Mercator projection. One of the drums, coupled to the motor, imparts to the band the required diurnal movement. As for the annual movement displayed by the movement of the crepuscular line, it can be produced using an array of diodes or of mini-lights placed between the ends of the band and controlled according to a program in such a way as to carry out the north-south or south-north movement just mentioned. The same array can also provide the display of nodes of routes when searching for paths between two distant points.

However, the geographic representation of the terrestrial globe can also be produced by purely electronic means, in which case the substrate takes the form of a screen, on which the map of the world appears and moves past starting from a recording. The superimposing of the crepuscular line on the map of the world does not present any difficulties. The use of the Mercator projection to represent the earth's surface has the advantage that the meridians are straight, parallel lines oriented north-south so that the time elements of the guide-mark are also such lines. Nevertheless use of other projections can be conceived, for example derived from a meridian projection. In that case, the shape of the meridians must change during the distance covered west-east, which the projection on a screen allows.

The devices described above for change of date and for display of routes can be adapted to a flat embodiment without any difficulty.

We claim:

1. A horometric device comprising on a base:

a substrate with a visible surface bearing a geographic representation of a terrestrial globe and marking of meridians;

a time guide-mark graduated into hours placed in juxtaposition with said visible surface;

a display means for making a crepuscular line appear on said visible surface representing the limits of illuminated zones and dark zones of the globe;

a motor assembly driven by a time base and producing relative displacements, actual or simulated, between the geographic representation and the time guide-mark with a period of 24 hours, and between a crepuscular plane in which said crepuscular line lies and the geographic representation, with a period of one year, the motor assembly simulating movement of the earth relative to the sun, and said relative displacement at a period of one year having an amplitude of +/−23.5 degrees, the motor assembly driving a continuous and regular movement of the globe with respect to said time guide-mark with a period of exactly 24 hours, wherein the geographic representation shows time zones on said globe and bears indicating symbols each situated on a meridian determining the local time in one of the time zones, the time guide-mark is a rigid body that includes elongated time elements covering said visible surface and extending in a direction of the meridians over a length sufficient to correspond visually with the indicating marks, one of the time elements being placed on 12 O'clock and determining with a straight line that represents a polar axis of the globe a solar plane, and either the solar plane is stationary with respect to the base and the oscillation is produced between a straight line and the polar axis, with the straight line being perpendicular to the crepuscular plane through a central point of the polar axis and lying in the solar plane, or the crepuscular plane is stationary with respect to the base and the solar plane oscillates about the straight line and the polar axis turns about the straight line of the crepuscular plane.

2. The horometric device according to claim 1, wherein a first relative displacement between the geographic representation and the crepuscular line is normally regular with a period of 365 times 24 hours, and this period can be modified to 366 times 24 hours every four years.

3. The horometric device according to claim 1, wherein the substrate is a rigid body having an axially symmetrical shape, integral with a drive arbor oriented along the polar axis of the geographical representation, the time guide-mark is another rigid body, coaxial to the substrate, and mounted on said arbor to turn with respect thereto, said arbor is guided by a socle mounted on the base and supporting said time guide-mark, and said display means for said crepuscular line and said indicating symbols both function by light emission and are mounted inside said substrate.

4. The horometric device according to claim 3, wherein said time guide-mark is integral with said socle, said socle being mounted to pivot with respect to said base about an axis perpendicular to said solar plane, with a period of one year, and the display means for displaying said crepuscular line is a light source equipped on one side with a screen, the light source being freely supported on an inside of said substrate about an axis perpendicular to said solar plane and equipped with a counterweight that keeps said light source in a fixed orientation with respect to the base when said socle oscillates about its axis.

5. The horometric device according to claim 1, wherein said substrate is a rigid body having an axially symmetrical shape integral with a drive arbor oriented along said polar axis of said geographic representation, said time guide-mark is another rigid body, coaxial to said substrate, mounted on said arbor so as to turn with respect thereto, said arbor is guided by a socle mounted on said base and supporting said time guide-mark, said socle is driven in rotation with respect to said base about a vertical axis and guides said arbor at an angle of 23.5 degrees with respect to a vertical axis, an axis of rotation of the socle cuts through an axis of said arbor at a central point of said substrate, the display means is fixed with respect to said base, and said time guide-mark is guided such that a horizontal line perpendicular to said crepuscular plane and passing through a center of said globe is continuously contained in said solar plane.

6. The horometric device according to claim 1, wherein said visible surface of said substrate is flat or curved, said geographic representation includes meridians made of straight, parallel lines, said time guide-mark is fixed and includes rectilinear time elements parallel and superimposed on said meridians, said display means is formed of a network of cells capable of excited and non-excited states, and said network of cells being sunk into said geographic representation and controlled by control means.

7. The horometric device according to claim 1, wherein said substrate is a rigid body having an axially symmetrical shape integral with a drive arbor oriented with said polar axis of said geographic representation, said time guide-mark is formed by a collar surrounding said arbor and by a predetermined number of transparent plates placed on edge radially on said collar, said plates being oriented in regularly spaced directions around said arbor, said edges of said plates situated facing an outer surface of said substrate forming said time elements and said collar having a 24 hour time gradation with which said time elements correspond.

8. The horometric device according to claim 1, wherein said substrate is a rigid body having an axially symmetrical shape integral with a drive arbor oriented with said polar axis of said geographic representation, said time guide-mark is another rigid body including a globe of transparent material having the shape of a part of said axially symmetrical rigid body substrate and a collar coaxial to said shell, said globe being engaged on said substrate so as to turn about said arbor and having visible lines that form said time elements, said collar having a 24 hour time gradation with which said time elements correspond.

9. The horometric device according to claim 1, wherein said display means further comprises means to indicate a differentiating change of date for time zones that have passed over a new date with respect to those time zones that are still at an old date.

10. The horometric device according to claim 9, wherein said means to indicate a differentiating change of date comprises a series of differentiating elements each of which undergoes a visible change of state at a moment when local time of a given time zone passes a 24/0 hour element, all of said differentiating elements undergoing a reverse change of state at a moment when a time zone containing a date change meridian passes the 24/0 hour element.

11. The horometric device according to claim 10, wherein said differentiating elements are distributed on said time guide-mark on a socle supporting said time guide-mark.

12. The horometric device according to claim 10, wherein said differentiating elements are distributed on said visible surface of said substrate.

13. The horometric device according to claim 1, wherein said display means includes means for selective activation responding to a command, said means being capable of exciting predetermined points on said geographic representation to make a route appear.

14. The horometric device according to claim 1, further comprising supplemental displacement means for allowing said base to rotate and components mounted thereon in a joint movement about a vertical axis with respect to a fixed foot, said supplemental displacement means being controlled by a hand or motor.

* * * * *